United States Patent [19]

Hall

[11] 4,367,446

[45] Jan. 4, 1983

[54] MODE COUPLERS

[75] Inventor: William J. Hall, Chelmsford, England

[73] Assignee: The Marconi Company Limited, Chelmsford, England

[21] Appl. No.: 41,826

[22] Filed: May 23, 1979

Related U.S. Application Data

[63] Continuation of Ser. No. 787,712, Apr. 14, 1977, abandoned.

[30] Foreign Application Priority Data

Apr. 20, 1976 [GB] United Kingdom ..... 15810/76

[51] Int. Cl.[3] ..... H01P 1/61

[52] U.S. Cl. ..... 333/135; 333/137; 333/21 R; 333/21 A

[58] Field of Search ..... 333/21 R, 21 A, 113, 333/126, 135, 137, 251

[56] References Cited

U.S. PATENT DOCUMENTS

| | | | |
|---|---|---|---|
| 2,720,629 | 10/1955 | Edson et al. | 333/21 R X |
| 2,731,602 | 1/1956 | Schwinger | 333/113 |
| 2,748,350 | 5/1956 | Miller | 333/21 R X |
| 2,851,687 | 9/1958 | Sferrazza | 333/21 A X |
| 3,184,695 | 5/1965 | Unger | 333/21 R X |
| 3,230,481 | 1/1966 | Lewis | 333/21 R X |
| 3,543,189 | 11/1970 | Standley | 333/135 |
| 4,048,592 | 9/1977 | Drabowitch | 333/21 R X |

*Primary Examiner*—Paul L. Gensler

*Attorney, Agent, or Firm*—Diller, Ramik & Wight

[57] ABSTRACT

The invention provides a mode coupler arrangement comprising a main waveguide coupled via arrays of slots to two sets of subsidiary waveguides over a common length. One set of subsidiary waveguides is such as to support one mode of propagation and the other set another mode of propagation. In a preferred embodiment the slots in one set of subsidiary guides are staggered by (1λ/4) relative to the slots in the other set of subsidiary guides and the guides of one set are longer than the guides of the other set.

For TE11 communications mode signals, the two sets of subsidiary guides are of different frequency, with each subsidiary guide arranged such that its variation of wavelength with frequency coincides with that of the main waveguide only in the frequency band for which that subsidiary guide is provided.

20 Claims, 7 Drawing Figures

MODE COUPLERS

This is a continuation of application Ser. No. 787,712 filed Apr. 14, 1977, now abandoned.

This invention relates to so-called mode couplers, that is to say couplers which will either combine or separate out different modes of propagation.

One common requirement is to selectively couple out of a main waveguide two modes of propagation. Such a requirement is met with in some tracking systems for satellite earth stations where, in order to provide a tracking signal, it is necessary to combine signals from two orthogonal TE21 modes of propagation received from the satellite earth station.

At present, in order to achieve such selective coupling out of the two modes, two separate travelling wave couplers are utilised in series. Such an arrangement suffers from a number of disadvantages. There is, for example, the difficulty that the coupling arrangement is of considerable length. Furthermore, the path length difference between signals from the two modes is considerable and thus adversely affects the bandwidth of the tracking system. In addition, as well as the two orthogonal modes, the signals in the main waveguide also commonly include a TE11 communications mode signal which is required to pass through the region in which the orthogonal TE21 modes are coupled out. With arrangements as at present known, using two separate travelling wave couplers in series, reflections in the TE11 mode can tend to occur which adversely affect the communications signal.

The present invention seeks to provide an improved mode coupler arrangement in which one or more of the above difficulties is reduced.

According to this invention, a mode coupler arrangement comprises a main waveguide and at least two subsidiary waveguides coupled to said main waveguide over a common length thereof, one of said subsidiary waveguides being such as to support and couple signals of one mode of propagation and the other of said subsidiary waveguides being such as to support and couple another mode of propagation.

Said main waveguide may be of any cross-section which will support the required modes.

Said two modes of propagation may be similar except for their polarisations and in one embodiment of the present invention said two modes are orthogonal TE21 modes of propagation.

Preferably for each mode at least one pair of subsidiary waveguides are provided in the same plane and on opposite sides of the axis of said main waveguide.

In one embodiment of the invention said main waveguide is circular and two pairs of subsidiary waveguides are provided for each mode signal, said subsidiary waveguides being symmetrically distributed around the outside of said main waveguide.

Preferably coupling between said subsidiary waveguides and said main waveguide is effected by arrays of slots, the slots in an array for one mode signal being staggered by the order of one quarter of a guided wavelength relative to the slots in an array for another mode signal.

Said two modes may comprise any suitable combination of modes, for example, a combination of TE01 and TM01 or a combination of TE21 and TM01.

Said coupler arrangement may also be provided to separate out two orthogonal TE11 communications mode signals. Where, as is common in this last mentioned case, said two TE11 communications mode signals are of different frequency band, normally each subsidiary waveguide will be arranged such that its variation of wavelength with frequency coincides with that of said main waveguide only in the frequency band of the mode signal for which that subsidiary waveguide is provided. To achieve this last mentioned effect, the subsidiary waveguide may be arranged, by, for example, corrugating at least one of its walls, or inserting suitable reactive loading, to exhibit a variation of wavelength with frequency which follows a curve of which is of different nature to that followed in the case of said main waveguide or the subsidiary waveguide may be arranged such that the relation between wavelength and frequency follows a curve which starts from a cut-off frequency and tends to an asymptote, which differs from those of the corresponding curve of said main waveguide. This last mentioned effect may be achieved by providing the subsidiary waveguide with a dielectric filling.

Normally each subsidiary waveguide is terminated at one end and provided with an output flange at its other end.

Preferably the subsidiary waveguide or waveguides for one mode of propagation is or are longer than the subsidiary waveguide or waveguides for the other mode of operation.

In a preferred arrangement including feeder waveguides coupled to said subsidiary waveguides, in each case the total length of a subsidiary waveguide with its feed waveguide is substantially the same.

The invention is further described with reference to the accompanying drawings in which, FIG. 1 is a part cut away perspective view of one mode separating coupler in accordance with the present invention, FIG. 2 is a longitudinal sectional view of the coupler of FIG. 1 in the plane A—A, FIG. 3 is an explanatory diagram relating to the coupler of FIGS. 1 and 2, FIG. 4 is a highly schematic diagram illustrating one application of the coupler of FIGS. 1 and 2, FIGS. 5, 6 and 7 are explanatory diagrams relating to the separation of other modes.

Referring to FIGS. 1 and 2, the coupler consists of a length of main waveguide 1 which in this case is of circular cross-section. This particular example of coupler is for use in selectively extracting energy from pairs of higher order modes or propagation in the waveguide 1 in order to provide signals from the two modes for combination to provide tracking information for tracking an earth satellite station from which the signals in the waveguide 1 originate.

In this particular case the two modes are orthogonal TE21 modes. Extending along the outside of the main waveguide 1 are two pairs of rectangular subsidiary waveguides 2, 3, and 4, 5 each of which is coupled to the interior of the main waveguide 1 by means of a series of slots such as those referenced 6 visible in the cut away portion of the subsidiary waveguide 5 in FIG. 1. The two pairs of subsidiary waveguides 2, 3 and 4, 5 are provided in order to extract one of the orthogonal TE21 modes propagated in the main waveguide 1.

Also extending along the outside of the main waveguide 1 are two further pairs of rectangular waveguides 7, 8 and 9, 10. The further subsidiary waveguides 7, 8 and 9, 10 are similarly coupled to the interior of the main waveguide 1 by series of slots, but, in this case in order to couple out the other of the two orthogonal TE21 modes.

It will be noted that the waveguides 2, 3 and 4, 5 provided for one of the two orthogonal TE21 modes and the subsidiary waveguides 7, 8 and 9, 10 provided for the other of the two orthogonal TE21 modes, are all coupled into the main waveguide 1 over the same part of the length thereof. This is best seen from the section shown in FIG. 2, in which the coupling slots are shown shaded. The series of coupling slots for the subsidiary waveguide 2 are represented at 11; those for subsidiary waveguide 3 are represented at 12; those for subsidiary waveguide 7 are represented at 13; those for subsidiary waveguide 4 are represented at 14 and those for subsidiary waveguide 9 are represented at 15.

The subsidiary waveguides 2, 3, 4, 5, 7, 8, 9 and 10 are terminated at one end, to the left as viewed, and each provided with output flanges at their other ends, to the right as viewed. The output flange for subsidiary waveguide 2 is represented at 16, that for subsidiary waveguide 3 is represented at 17, that for subsidiary waveguide 5 is represented at 18, that for subsidiary waveguide 8 is represented at 19 and that for subsidiary waveguide 10 is represented at 20. It will be noted that the output flanges 16, 17 and 18 for subsidiary guides 2, 3 and 5 are provided at one distance along the length of the main waveguide 1, whereas the output flanges 19 and 20 provided for subsidiary waveguides 8 and 10 are provided at a greater distance along the length of the main waveguide 1. The output flange provided for subsidiary waveguide 4 cannot be seen in FIG. 1, but is provided at the same distance along the main waveguide 1 as the flanges 16, 17 and 18, while output flanges for waveguides 7 and 9, also not visible in the view of FIG. 1, are provided at the greater distance along the main waveguide 1 of output flanges 19 and 20.

The fact that the output flanges provided for the one of the two orthogonal TE21 modes are positioned a shorter distance along the main waveguide 1 than the output flanges provided for the other of the two orthogonal TE21 modes is not only of mechanical convenience, but also the separation can be utilised to achieve an increase in the bandwidth of a phase difference between propagated modes. To explain this one may consider the case where the shorter subsidiary waveguides 2, 3, 4 and 5 and the longer subsidiary waveguides 7, 8, 9 and 10 are fed by a network of standard waveguides such that the total lengths of any subsidiary waveguide and its standard feed waveguide are substantially the same and such as to excite the two modes in a required phase relationship. Thus the lengths of standard feed waveguides provided for the shorter subsidiary waveguides 2, 3, 4 and 5 will be longer than the lengths of standard feed waveguide provided for the longer subsidiary wavelengths 7, 8, 9 and 10.

Thus the feed of one set of couplers, i.e. those of shorter subsidiary waveguides 2, 3, 4 and 5, will be through a given length of standard feed waveguide and a given length of subsidiary waveguide plus an additional length of standard feed waveguide, while the feed of the other set of couplers, i.e. those of longer subsidiary waveguides 7, 8, 9 and 10, will be through the same given length of subsidiary waveguide and the same given length of standard feed waveguide plus an extra length of subsidiary waveguide.

Thus, while providing that the overall combined lengths of feeder and subsidiary waveguides is the same, the phase difference between the two modes of propagation is determined by the difference in propagation constants between the additional lengths of standard feed waveguide on the one hand and the additional lengths of subsidiary waveguide on the other, or in other words the difference in length between a shorter subsidiary waveguide and a longer subsidiary waveguide.

This may be expressed mathematically as follows:

If the phase difference required is $\phi$ and the length and propagation constant of each extra length of standard feed waveguide are respectively $l_1$ and $\beta_1$ and the length and propagation constant of the extra length of each subsidiary waveguide are respectively $l_2$ and $\beta_2$, then $$\phi = \beta_1 l_1 - \beta_2 l_2$$

and $$\frac{d\phi}{d\omega} = \frac{d\beta_1}{d\omega} l_1 - \frac{d\beta_2}{d\omega} l_2.$$

If the guides are of type $\beta_1 = \beta_2$, $$\text{and } \therefore \frac{d\phi}{d\omega} = \frac{d\beta}{d\omega}(l_1 - l_2)$$

This is fixed and for many applications will be too large. In the case where $\beta_1 \neq \beta_2$, $$\frac{d\phi}{d\omega} = \frac{d\beta_1}{d\omega} l_1 - \frac{d\beta_2}{d\omega} l_2$$

In the case of guides operating at a frequency well above their cut off frequency.

$$\frac{d\beta_1}{d\omega} \approx \frac{d\beta_2}{d\omega}$$

so $$\frac{d\phi}{d\omega} \approx \frac{d\beta}{d\omega}(l_1 - l_2)$$

again. But in this case it is possible to achieve any phase difference with $l_1 \approx l_2$, so that $(d\phi/d\omega)$ tends to zero.

The dimensioning of the coupling slots for each of the subsidiary waveguides is in accordance with known practice.

Referring to FIG. 3, this diagram schematically represents a section through the main waveguide 1 of FIGS. 1 and 2 and relates the position of each of the subsidiary waveguides 2, 3, 4, 5, 7, 8, 9 and 10 to the mode which is coupled out thereby. One of the two orthogonal modes is specified by "TE21", while the other of the two orthogonal modes is specified by "TE21'". The symbol "LS" indicates that the coupling slots are longitudinal slots.

In addition to the two orthogonal TE21 modes referred to above, there is also propagated within the main waveguide 1 a TE11 communications signal which passes through the length of the main waveguide 1. The provision of two pairs of subsidiary waveguides for each of the two orthogonal TE21 modes to be coupled out of the main waveguide 1 results in a symmetrical system tending to reduce depolarisation of the TE11 modes which are propagated through the coupling region. Reflections in the TE11 communications mode may be reduced by staggering the arrays of coupling slots provided for one of the two orthogonal TE21 modes relative to the arrays of coupling slots provided for the other of the two orthogonal TE21 modes by one quarter of a guided wavelength, in order to provide reflection cancellation over a moderately wide frequency band.

Compared with a conventional arrangement for coupling out two orthogonal TE21 modes, in which a coupler for one is provided in series with a coupler for the other, not only is the overall length of the coupler arrangement reduced, but also the bandwidth of the tracking system is increased, since the path length difference between signals from the two orthogonal modes is greatly reduced (from tens of wavelengths to fractions of a wavelength or zero).

Referring to FIG. 4, this represents an earth satellite station tracking system incorporating a mode separator as shown in FIGS. 1 and 2. The mode separator is represented by the block 21 which is fed with signals received from the satellite earth station via a radio horn 22. The outputs of the subsidiary waveguides 2, 3, 4 and 5, provided for the one of the two orthogonal TE21 modes are combined to provide one input 23 to a Magic Tee circuit 24. The outputs of the subsidiary waveguides 7, 8, 9 and 10 are combined to provide a second input 25 for the Magic Tee circuit 24. The orthogonal mode signals are combined by the Magic Tee 24 whose output is connected to an LNA (low noise amplifier) 26, the output of which is applied to a tracking receiver 27. The TE11 communications mode, passing through the mode separator 21 is applied to an output waveguide 28 for utilisation, while a portion of the TE11 communications mode is coupled out and provided as an input for the tracking receiver 27.

Except for the nature of the mode separator 21, the tracking system schematically illustrated in FIG. 4 is as well known per se. Azimuth and elevation deflection signals appear respectively at outputs 29 and 30 of the tracking receiver 27.

The invention is applicable to the separation of other mode combinations. For example, the combination TE01/TM01 and the combination TE21/TM01 which are other mode combinations commonly used in satellite tracking systems. For each of these other mode combinations the general configuration of the coupler will be as illustrated in FIGS. 1 and 2, except, for the nature of the coupling slots. For the TM01 mode, for example, the coupling slots will be transverse as opposed to longitudinal.

In FIG. 5, the notation "TS" denotes a transverse slot, whilst again the notation "LS" denotes a longitudinal slot.

FIG. 7 represents the case where the modes to be separated are two orthogonal TE11 communications mode, in other words illustrates the case where the coupler is used as an Orthomode junction. It is believed that a detailed description of FIGS. 6 and 7 is not necessary in view of the description which has already been given in respect of FIGS. 3 and 5, since the notations used are similar.

Figures 1, 4:
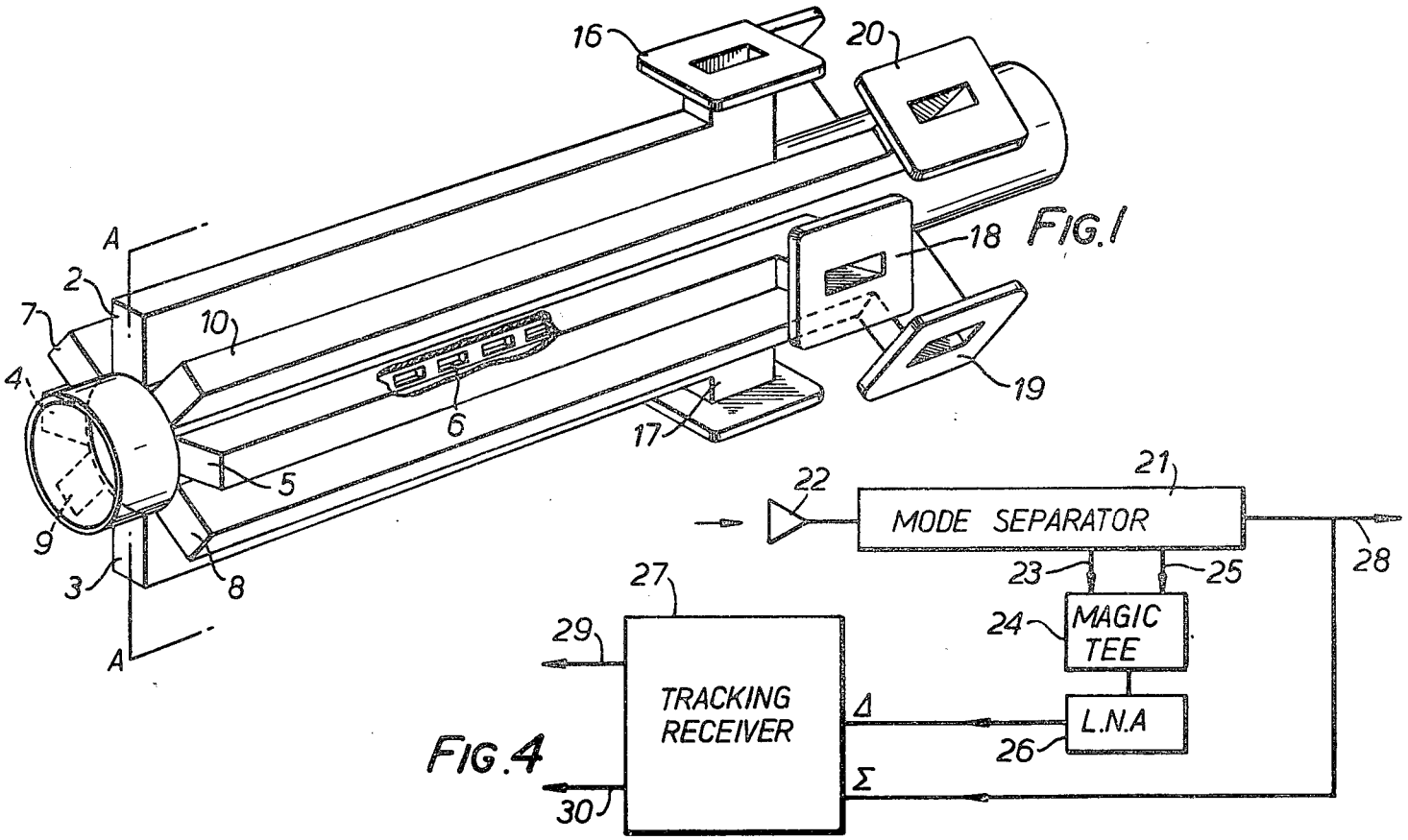
Figure 2:
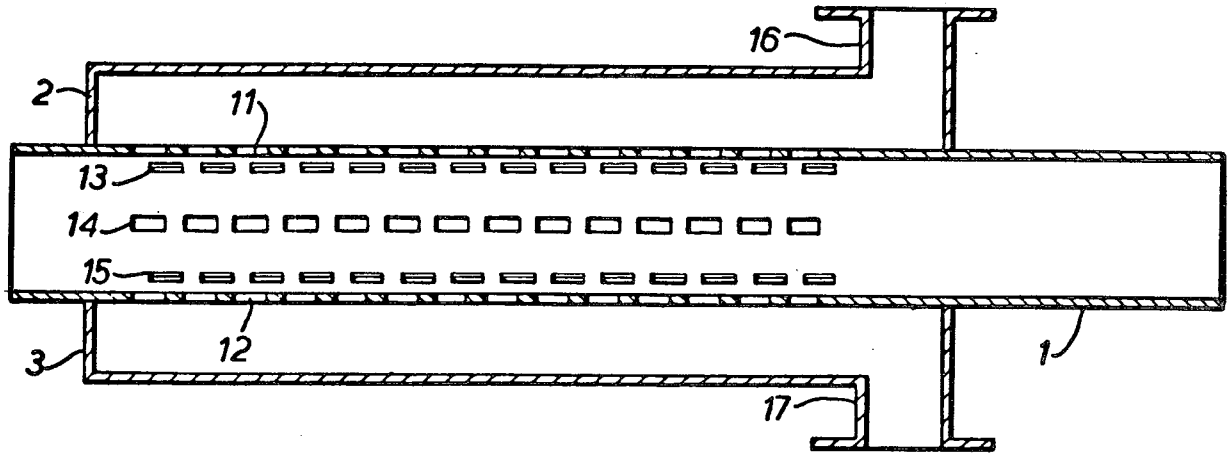
Figure 3:
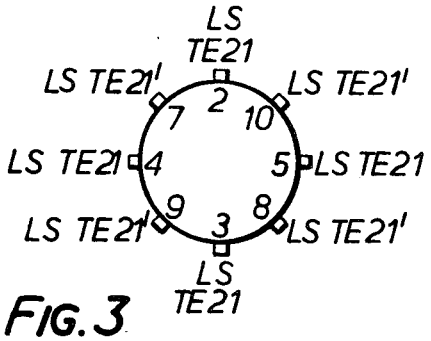
Figure 5:
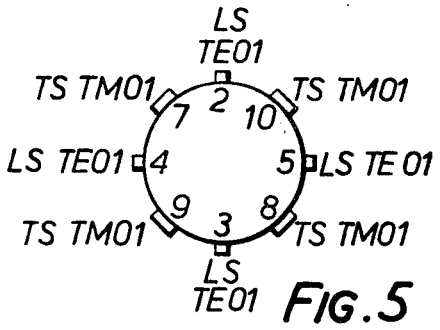
FIG. 5 is a diagram like that of FIG. 3, but illustrating the case where the modes to be separated are not two orthogonal TE21 modes but a combination of TE01 and TM01 modes.
Figure 6:
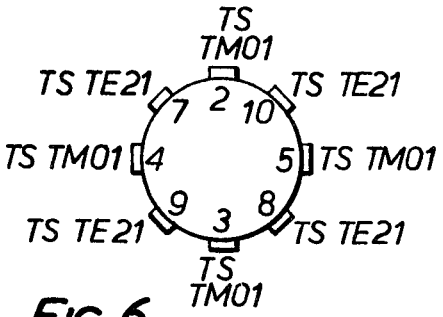
FIG. 6 represents the case where the mode combination is TM01/TE21.
Figure 7:
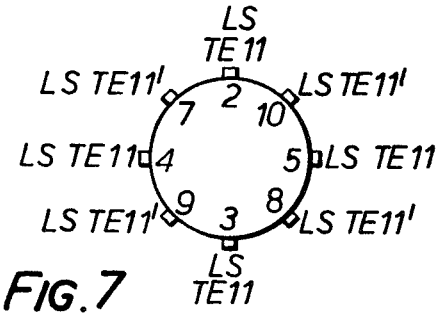

In the case of an Orthomode junction such as is illustrated in FIG. 7, it is usual for the two orthogonal TE11 communications modes to be of different frequencies in which case the subsidiary waveguides 2, 3, 4 and 5 couple out one TE11 frequency band, while the subsidiary waveguides 7, 8, 9 and 10 couple out the other TE11 frequency band. The bandwidth of coupling is selected by designing the subsidiary guides such that wavelength equality between the subsidiary guides and the main waveguide, upon which high coupling depends, occurs only in selected bands. The set of subsidiary waveguides 2, 3, 4 and 5 are provided to be of frequency characteristic appropriate to the one frequency band, while the other set of subsidiary waveguides 7, 8, 9 and 10 are appropriate to the other frequency band. To achieve band pass characteristic, each subsidiary waveguide is arranged such that its variation of wavelength with frequency only coincides with that of the main circular guide in the appropriate frequency band. This is achieved either by arranging for the wavelength and frequency of each subsidiary guide to follow a curve which is different from that of the main waveguide 1 (for example, by providing the subsidiary guide to be corrugated) or by arranging for the relation between wavelength and frequency of a subsidiary guide to start from a cut-off frequency and tend to an asymptote which are different from those of the main guide (for example, by providing the subsidiary guide with a dielectric filling).

I claim:

1. A mode coupler arrangement comprising a main waveguide and at least two subsidiary waveguides coupled to said main waveguide over a common length thereof, one of said subsidiary waveguides being such as to support and couple signals of one mode of propagation and the other of said subsidiary waveguides being such as to support and couple another mode of propagation, the coupling between said subsidiary waveguides and said main waveguide being effected by arrays of apertures, the apertures in the array for said one subsidiary waveguide being staggered by the order of one quarter of a guided wavelength relative to the apertures in the array for said other subsidiary waveguide.

2. An arrangement as claimed in claim 1 and wherein said two modes of propagation are similar except for their polarisations.

3. An arrangement as claimed in claim 1 and wherein for each mode at least one pair of subsidiary waveguides are provided in the same plane and on opposite sides of the axis of said main waveguide.

4. An arrangement as claimed in claim 1 and wherein said main waveguide is circular and two pairs of subsidiary waveguides are provided for each mode signal, said subsidiary waveguides being symmetrically distributed around the outside of said main waveguide.

5. An arrangements as claimed in claim 1 and wherein said two modes are orthogonal TE21 modes of propagation.

6. An arrangements as claimed in claim 1 and wherein said two modes are a combination of TE01 and TM01.

7. An arrangement as claimed in claim 1 and wherein said two modes comprises a combination of TE21 and TM01.

8. An arrangement as claimed in claim 1 and wherein said coupler arrangement is provided to separate out two orthogonal TE11 communications mode signals.

9. An arrangement as claimed in claim 8 and wherein said two TE11 communications mode signals are of different frequency band.

10. An arrangement as claimed in claim 9 and wherein each subsidiary waveguide is arranged such that its variation of wavelength with frequency coincides with that of said main waveguide only in the frequency band of the mode signal for which the subsidiary waveguide is provided.

11. An arrangement as claimed in claim 10 and wherein said subsidiary waveguide is arranged to exhibit a variation of wavelength with frequency which follows a curve which is of different nature to that followed in the case of said main waveguide.

12. An arrangement as claimed in claim 10 and wherein said subsidiary waveguide is arranged such that the relation between wavelength and frequency follows a curve which starts from a cut-off frequency and tends to an asymptote, which differs from those of the corresponding curve of said main waveguide.

13. An arrangement as claimed in claim 1 and wherein each subsidiary waveguide is terminated at one end and provided with an output flange at its other end.

14. An arrangement as claimed in claim 1 and wherein said one subsidiary waveguide is longer than said other subsidiary waveguide.

15. An arrangement as claimed in claim 1 wherein said apertures of each array are slots.

16. A mode coupler arrangement comprising, in combination:

a main waveguide within which first, second and third modes of electromagnetic energy are propagated; and coupler means for coupling out said first and second modes of electromagnetic radiation while permitting said main waveguide to propagate said third mode of electromagnetic radiation with substantially no reflection thereof, said means comprising a first set of subsidiary waveguides and a second set of subsidiary waveguides, there being at least two subsidiary waveguides in each set, each subsidiary waveguide of said first set being of the same predetermined length having termination means at one end and output flange means at its other end, the at least two subsidiary waveguides of said first set being disposed longitudinally along said main waveguide at opposite side positions thereof and along a common length thereof, first aperture means for coupling said first mode of electromagnetic energy into said first set of subsidiary waveguides, each subsidiary waveguide of said second set being of the same predetermined length having termination means at one end and output flange means at its opposite end, the at least two subsidiary waveguides of said second set being disposed longitudinally along said common length of said main waveguide at opposite side portions thereof, second aperture means circumferentially displaced with respect to said first aperture means for coupling said second mode of electromagnetic energy into said second set of subsidiary waveguides, and said second aperture means being staggered with respect to said first aperture means by the order of one quarter of a guided wavelength whereby to cancel reflections of said third mode of electromagnetic energy propagated through said common length of the main waveguide.

17. A mode coupler arrangement as defined in claim 16 wherein said first and second modes are orthogonal TE21 modes and said third mode is a TE11 mode.

18. A mode coupler arrangement as defined in claim 17 wherein there are four subsidiary waveguides in each set and four associated aperture means therefor, the subsidiary waveguides of both sets being symmetrically distributed around said main waveguide with alternate subsidiary waveguides belonging to the same set.

19. A mode coupler arrangement as defined in claim 18 wherein each aperture means is in the form of a longitudinally spaced array of slots.

20. A mode coupler arrangement as defined in claim 19 wherein said predetermined length of each subsidiary waveguide of said first set is greater than said predetermined length of each subsidiary waveguide of said second set.

* * * * *